US007458884B2

(12) United States Patent
Falk

(10) Patent No.: US 7,458,884 B2
(45) Date of Patent: Dec. 2, 2008

(54) GRINDING DISC FOR GRINDING MACHINES

(75) Inventor: Ulrich Falk, Trappenkamp (DE)

(73) Assignee: UFI Schleiftechnik GmbH & Co. KG, Nehmten O. T. Bredenbek (DE)

( * ) Notice: Subject to any disclaimer, the term of this patent is extended or adjusted under 35 U.S.C. 154(b) by 23 days.

(21) Appl. No.: 10/547,991

(22) PCT Filed: Jul. 14, 2004

(86) PCT No.: PCT/EP2004/007755

§ 371 (c)(1),
(2), (4) Date: Sep. 7, 2005

(87) PCT Pub. No.: WO2005/016600

PCT Pub. Date: Feb. 24, 2005

(65) Prior Publication Data

US 2006/0189268 A1 Aug. 24, 2006

(30) Foreign Application Priority Data

Aug. 11, 2003 (DE) ..... 203 12 499 U

(51) Int. Cl.
*B24B 23/00* (2006.01)

(52) U.S. Cl. ..... 451/359; 451/456; 451/548; 451/488

(58) Field of Classification Search ..... 451/359, 451/456, 353, 548, 488
See application file for complete search history.

(56) References Cited

U.S. PATENT DOCUMENTS

| | | | | |
|---|---|---|---|---|
| 1,778,470 | A | 10/1930 | Stratford | |
| 4,158,935 | A * | 6/1979 | Robert | 451/359 |
| 5,609,516 | A * | 3/1997 | Courson et al. | 451/456 |
| 5,919,085 | A * | 7/1999 | Izumisawa | 451/357 |
| 6,299,522 | B1 * | 10/2001 | Lee | 451/548 |
| 6,368,199 | B1 | 4/2002 | Van Osenbruggen | |
| 6,527,631 | B2 * | 3/2003 | Wuensch et al. | 451/357 |
| 6,527,634 | B2 * | 3/2003 | Lee et al. | 451/548 |
| 6,743,086 | B2 * | 6/2004 | Nelson et al. | 451/527 |
| 7,033,262 | B2 * | 4/2006 | Takizawa et al. | 451/490 |

FOREIGN PATENT DOCUMENTS

| | | |
|---|---|---|
| DE | 2 145 714 | 3/1972 |
| DE | 89 02 423 | 6/1989 |
| DE | 40 32 069 | 9/1991 |
| DE | 44 00550 | 7/1995 |
| DE | 201 05 199 | 9/2002 |
| EP | 0 557 773 | 9/1993 |
| EP | 0 781 629 | 7/1997 |
| EP | 1 074 347 | 2/2001 |

* cited by examiner

*Primary Examiner*—Eileen P. Morgan
(74) *Attorney, Agent, or Firm*—Friedrich Kueffner

(57) ABSTRACT

In a grinding disk (100) for the rotary slaving on a driven shaft of a grinding machine, in particular of a hand grinder, which has at least one supporting plate (10) with at least one cut or opening (20) through which the abrasive dust which develops by grinding can be sucked by means of at least one suction bell placed in or on the grinding machine, the cut or opening (20) is configured aerodynamically.

5 Claims, 6 Drawing Sheets

GRINDING DISC FOR GRINDING MACHINES

FIELD OF APPLICATION

This invention relates to the technical field of the grinding machines, in particular of the hand grinders, and this being in particular to a grinding disk for the rotary slaving on a driven shaft of a grinder.

STATE OF THE ART

A known grinding disk 100 for the rotary slaving on a driven shaft 202 of a hand grinder 200 is represented in FIG. 1.

This grinding disk 100 has a supporting plate 10 with several cuts (=openings 20) with an approximately circular cross section; the air flow or air current takes place through these cuts 20 with the abrasive means dust 300, i.e. the abrasive dust 300 or the like (for example further fine impurities which develop when grinding and are removed together with the abrasive dust) which develops when grinding can be sucked through these openings 20 by using a suction bell 206 placed in or on the grinding machine 200, which is not represented in detail on FIG. 1 for more clarity of the drawing.

Such a grinding disk is disclosed in the EP-A-0 557 773. For this known device, a rotary slaving of the grinding disk takes place on the driven shaft of the hand grinder, whereby this grinding disk self-centers on the driven shaft, in particular on a catch.

Furthermore, it is known for hand grinders configured as right angle grinders to flange a suction housing with an elastically deformable suction collar to their housing. This suction housing is provided with an exhaust air muff from which a suction hose extends to the respective suction device. A laterally projecting handle is provided on the machine housing.

According to the DE-A-40 32 069, the handle is placed on the protection housing serving simultaneously as a suction housing for driving elements of the grinding disk, is hollow and is connected with the hollow space of the protection housing. The handle forms an outlet tube for the abrasive dust at the free end of which the suction hose is fixed which extends off the handle of the hand grinder.

From the DE-A-21 45 714, we know a grinding tool of the type which has a flexible replaceable wheel, the working surface of which is covered with an abrasive-adhesive means mixture and the other side of which bears on a disk which is provided with a hub for applying onto the end of a high-speed rotating shaft.

The grinding wheel according to the DE-A-21 45 714 has on its whole surface holes forming a perforation which are connected with the approximately radial ducts in the inside of the disk and the other end of which opens on the outside.

In the EP-A-0 781 629, an abrasive wheel is known which is adaptable directly or indirectly with a machine or with a manually operatable abrasive means holder as well as an appropriate adapter for fixing for working on a machine grinding disk or on a grinding disk or onto an actuatable abrasive means holder with or without suction. At least the abrasive wheel has a perforation which is distributed uniformly over the whole surface of the abrasive wheel or which is at least partially placed and which penetrates at least through the layer with abrasive means, whereby the distance of the single openings forming the perforation the one from the other and with respect to the suction devices of the grinding disk or of the grinding wheel is chosen such that a practically unjammed transport of the abrasive dust should be made possible.

It is known by the DE-A-44 00 550 that the suction openings of grinding wheels have at the one end outlet areas, the openings of which are widened so that a good dust flow should be guaranteed even for eccentrically applied grinding disks.

The DE 89 02 423 U1 provides the use of grinding wheels made of abrasive cloth with any hole pattern, whereby each cut situated on an inner circular line opens on the bottom of a recess which extends from the inner circular line to a central third circular line.

However, it is common to the subjects discussed above according to the prior art that the air flow or air current does not arrive with the abrasive dust unjammed into the cuts or openings of the supporting plate.

Aim, Solution, Advantage

Starting from the disadvantages and inadequacies explained above as well by acknowledging the outlined prior art, the aim of this invention is to further improve a grinding disk of the above mentioned type in such a way that the air flow or air current arrives with the abrasive dust unjammed into the cuts or openings of the supporting plate.

This aim is achieved according to the teachings of this invention by a grinding disk with the characteristics mentioned in claim 1.

Advantageous configurations and appropriate further improvements of this invention are characterized in the subclaims.

Consequently, the core of this invention consists in a configuration of the grinding disk, in particular of the supporting plate, for which the cuts or openings provided in the supporting plate for sucking off the abrasive dust are aerodynamically formed.

The air flow or air current with the abrasive dust is optimized by these aerodynamically favourable configuration of the abrasive dust suction cuts or openings and the path of the air flow or air current is simplified so that the air flow or air current arrives substantially unjammed into the cuts or openings; due to the rotation of the grinding disk an increase of the air flow or air current through the cuts or openings takes place and thus an increase of the suction force.

According to the invention, a practically unjammed transport of the abrasive dust is caused so that a perfect abrasive result is achieved since the grinding wheel cannot be clogged any longer or hardly by grinding dust which has been ground off. Thus, a considerably increased service and working life of the grinding body is achieved.

According to a particularly inventive further improvement of this grinding disk, at least one canal guide for the air with the abrasive dust is provided on the lower side of the supporting place turned to the abrasive disk.

Finally, the invention relates to a grinding machine, in particular a hand grinder, which has at least one grinding disk of the above mentioned type.

As already discussed above, there are several possibilities to configure and further improve the teaching of this invention. To this, on the one hand it is referred to the claims following claim 1. On the other hand, further configurations, characteristics and advantages of this invention will be explained in detail by means of he embodiment illustrated by the FIG. 2 to 6.

SHORT DESCRIPTION OF THE INVENTION

Embodiments of the invention are explained in detail below by means of the drawings.

Figure 1:
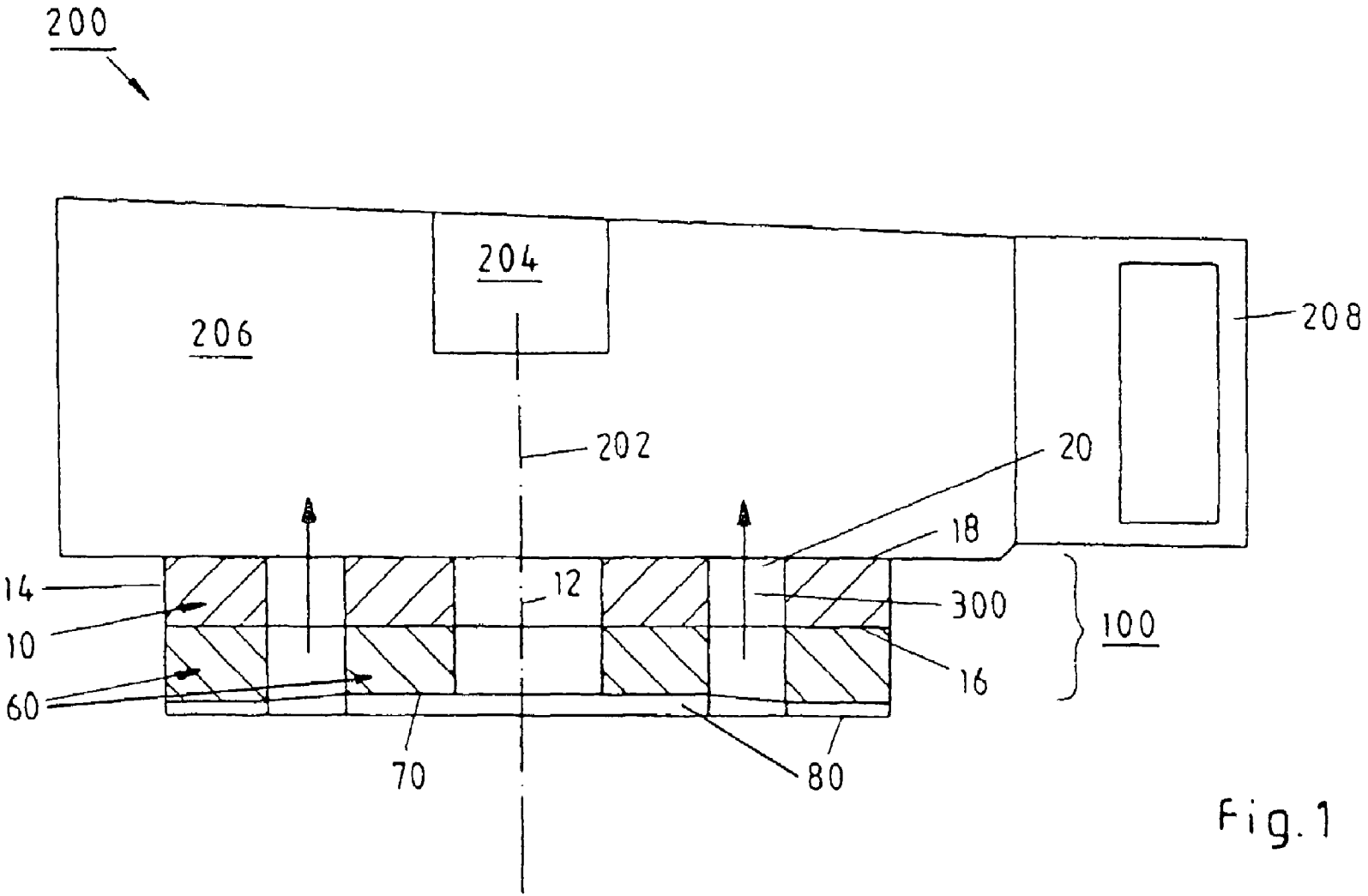
FIG. 1 shows a cross section representation of a grinding disk associated to a hand grinder with suction bell, grinding disk on which an abrasive disk is fixed.

DETAILED DESCRIPTION OF THE INVENTION AND BEST WAY FOR CARRYING OUT THE INVENTION

The same or similar configurations, elements or characteristics are provided in the FIG. 1 to 6 with identical reference numerals.

In FIG. 2 to 6, a grinding disk 100 is represented which can be driven eccentrically by means of a hand grinder 200 configured in particular as a right angle grinder. To this, such a hand grinder 200 has a driving engine 204 with a preferably right-angled outcoming driven shaft 202 by means of which the grinding disk 100 is driven in the course of the rotary slaving (see FIG. 1).

A protection housing for the driving elements of the grinding elements 100 can be fixed on the housing of the hand grinder 200; this protection housing serves simultaneously as suction housing for the 300 which develops when grinding. Furthermore, a handle 208 by means of which the hand grinder 200 can be held during the grinding procedure is fixed to the housing of the hand grinder 200 (see FIG. 1).

The abrasive disk 80 causing the proper grinding procedure is held by means of a Velcro closer 70 to a cushion or pad 60 which is fixed on the surface 16 of the supporting plate 10 which is turned off the hand grinder 200 (see FIG. 1). Consequently, the lower side 16 (=the surface turned off the grinding machine 200) constitutes a bearing surface for the cushion or pad 60 and thus via the Velcro closer 70 for the abrasive disk 80 as well.

As it can be seen in the representation of FIG. 2 to 6, the grinding disk 100 has a supporting plate 10 made for example of metal with a total of eight cuts (=eight dust suction openings 20) through which the abrasive dust 300 developing by grinding (eventually together with further fine impurities) can be sucked by means of the suction bell 206 placed in the hand grinder 200; the proper hand grinder 200 is provided with suction devices (so-called suction bells or exhaust bells 206) for the abrasive dust.

Figure 2:
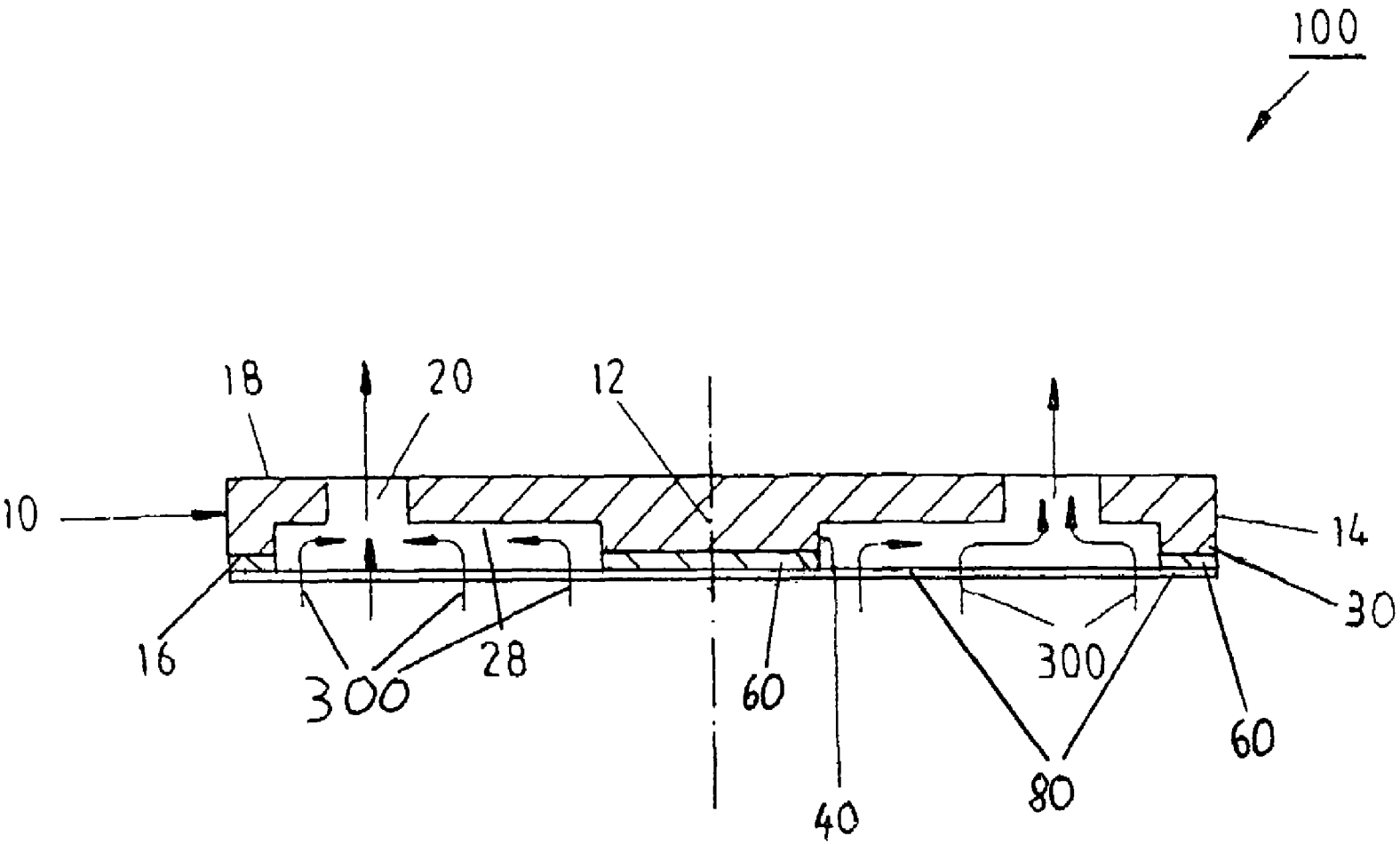
FIG. 2 shows a cross section representation of an embodiment for a grinding disk according to this invention.

As it results from the representation of FIG. 2, the lower side 16 of the supporting plate 10 turned off the hand grinder 200 (in this embodiment: eight) has air guiding ducts 28 for the supplying of the sucked abrasive dust 300 to the cuts 20 through which the abrasive dust 300 is then sucked.

These duct guides 28 are essential for the air with the abrasive dust 300 on the lower side 16 of the supporting plate 10 because in this way the air flow or air current arrives unjammed and substantially free into the openings 20.

The particularity of the grinding disk 100 according to FIG. 2 to 6 consists only in that the openings 20 are aerodynamically formed in the supporting plate 10 of the grinding disk 100; there is thus an aerodynamic configuration for the dust suction openings (=cuts 20) so that the air flow or air current with the abrasive dust 300 arrives unjammed into the cuts or openings 20 of the supporting plate 10.

Figure 4:
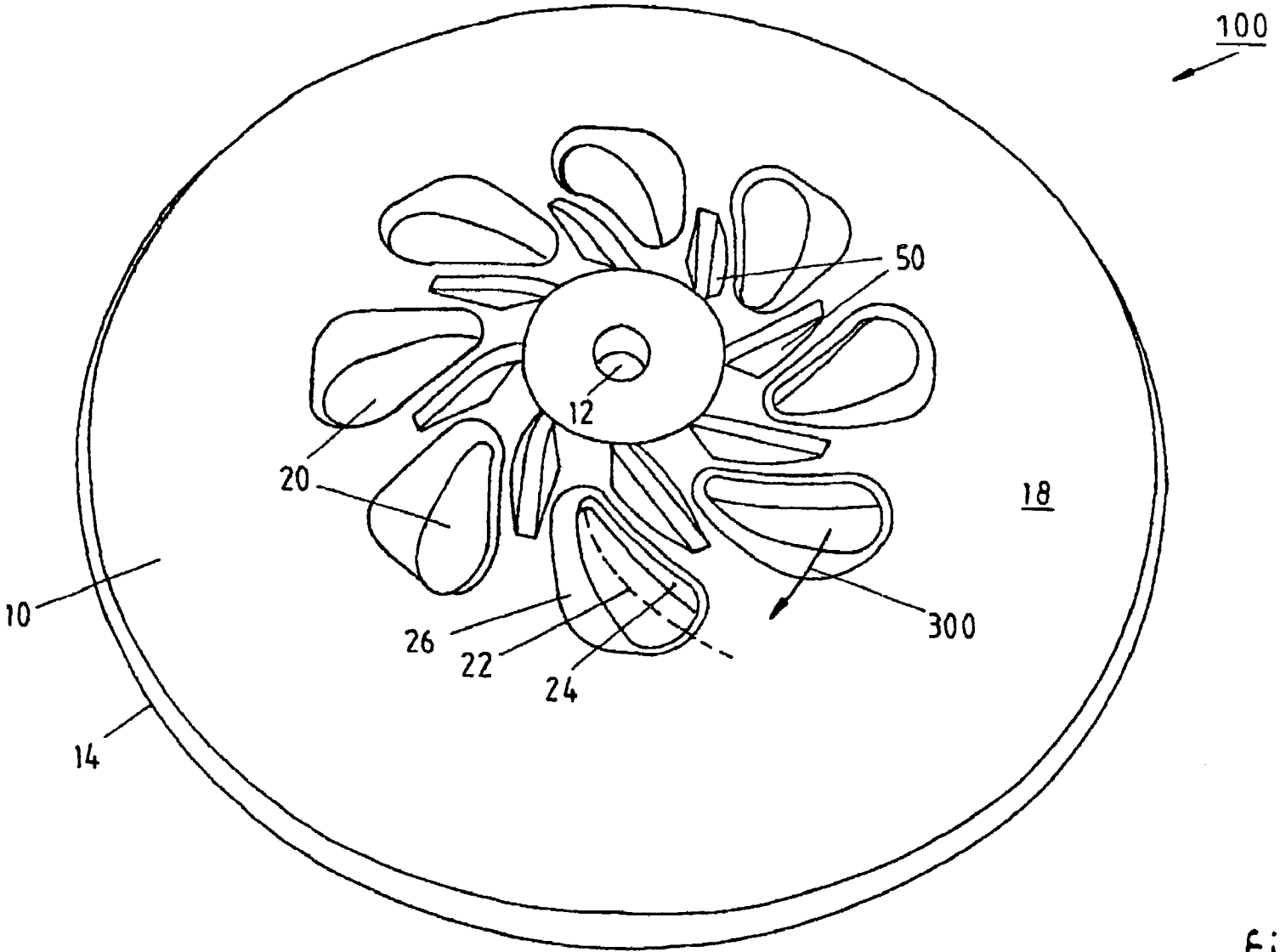
FIG. 4 is a perspective view of the grinding disk of FIGS. 2 and 3.
Figure 5:
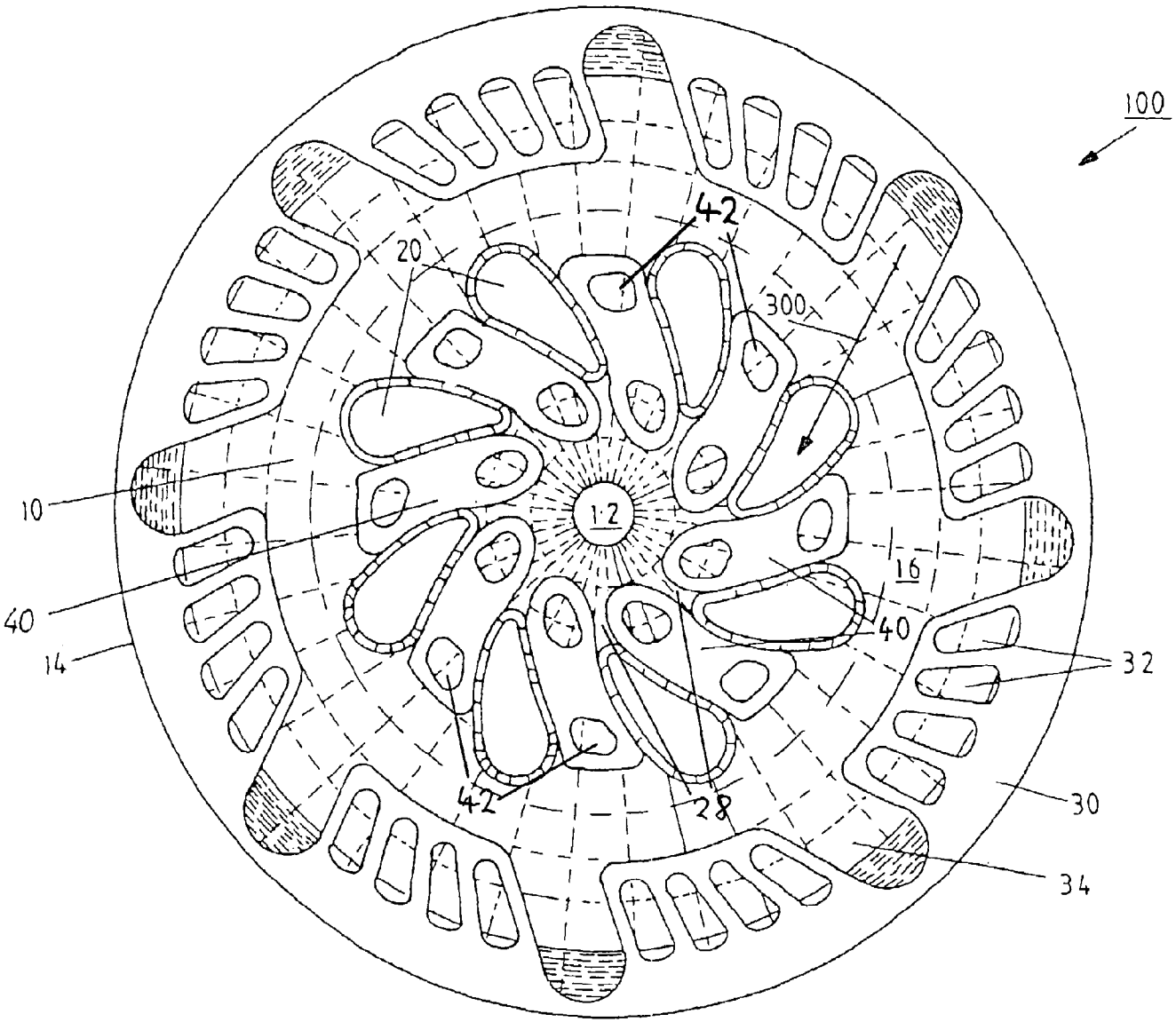
FIG. 5 shows a front view from below of the grinding disk of FIG. 2 to 4.
Figure 6:
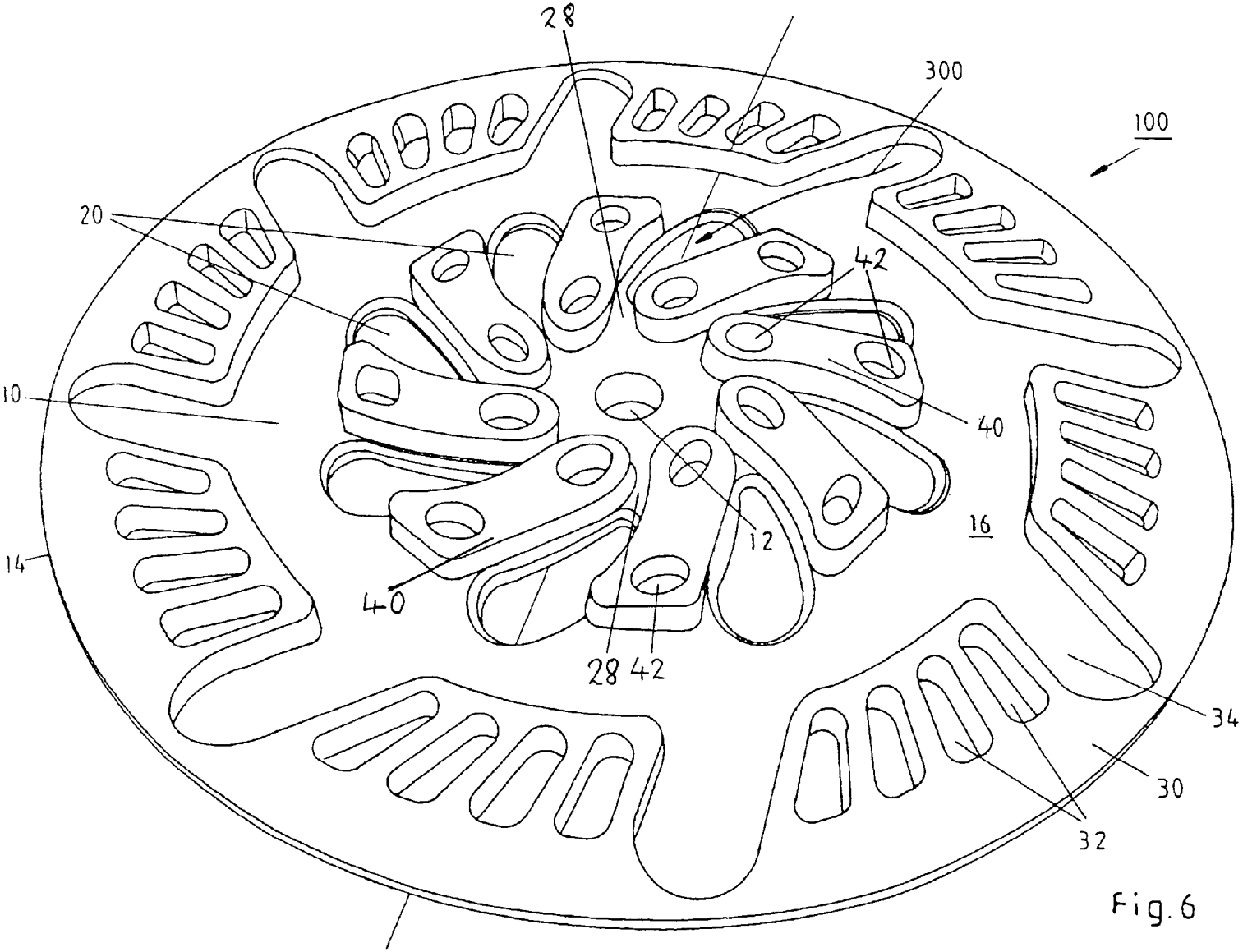
FIG. 6 is a perspective view from below of the grinding disk of FIG. 2 to 5.

The cuts 20 are configured approximately oval and extend from the center 12 of the supporting plate 10 radially to the peripheral edge 14 of the supporting plate 10 (see FIG. 3 to 6), whereby the openings 20 extend with their longitudinal center line 22 approximately with the shape of an arc of a circle (see FIGS. 5 and 6).

Moreover, it can be seen on the representation of FIG. 3 to 6 that each opening 20 widens in direction away from the center 12 of the supporting plate 10 to the periphery 14 of the supporting plate 10, i.e. the distance between the first longitudinal side edge 24 of the opening 20 and the second longitudinal side edge 26 of the cut 20 is smaller in the area turned to the center 12 of the supporting plate 10 than in the area turned to the peripheral edge 14 of the supporting plate 10.

A further characteristic essential to the invention is given by an oblique start grinding of the longitudinal lateral edges 24, 26 of each cut 20. While the first longitudinal lateral edge 24 which is hardly detected by the air flow or air current because of the direction of this air flow or air current of the abrasive dust 300 of the opening 20 runs approximately vertically, i.e. is only very weakly ground or chamferred, the second longitudinal lateral edge 26 of the opening 20 which is strongly detected by the air current or air flow of the abrasive dust 300 is strongly ground or chamferred in order to offer the air flow or air current of the abrasive dust 300 as little resistance as possible so that the air flow or air current arrives with the abrasive dust 300 unjammed into the aerodynamically formed cuts or openings 20 of the supporting plate 10.

Basically, the cuts 20 can be big or small. In the case that only one cut 20 (or for example an odd number of cuts 20) is provided, the supporting plate 10 is to be balanced by applying further masses. In any case, the prescribed aerodynamic configuration of the cuts 20 is essential to the invention.

On the upper side 18 of the supporting plate 10 which is turned to the hand grinder 200, radially extending stiffening webs 50 are provided by means of which the pressure loads of the supporting plate 10 are intercepted. These eight stiffening webs 50 extend respectively into approximately half the area between respectively two cuts or openings 20.

Figure 3:
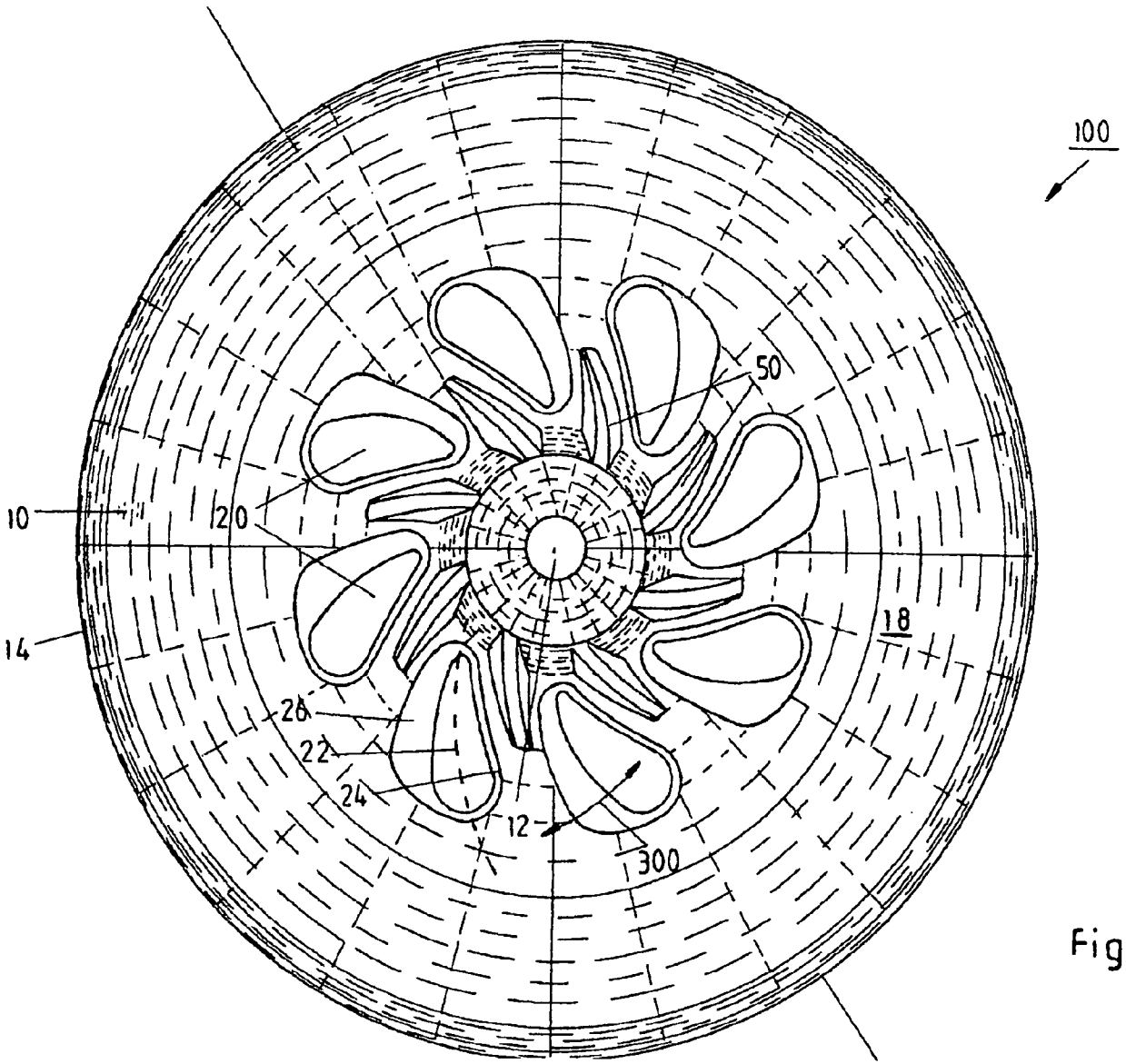
FIG. 3 is a front top view of the grinding disk of FIG. 2.

While in FIGS. 3 and 4 the upper side 18 of the supporting plate 10 which is turned to the hand grinder 200 is represented, the FIGS. 5 and 6 show the lower side 16 of the supporting plate 10 which is turned off the hand grinder 200.

A total of eight mouldings 40 between respectively two openings 20 are placed on the lower side 16 of the supporting plate 10; these raised mouldings 40 provided with recesses 42 have the shape of the contour of the intermediate space between the openings 20 and serve for the improved guiding of the air flow or air current containing the abrasive dust 300 into the cuts 20.

Furthermore, a raised edge section 30 which is provided with recesses 32 as well as with openings 20 for collecting and accelerating the air flow or air current of the abrasive dust 300 of spatially associated indentations 34, this raised edge section serving like the mouldings 40 for supporting and bearing the cushion or pad 60.

LIST OF REFERENCE NUMERALS

100 Grinding disk
10 Supporting plate
12 Center of the supporting plate 10
14 Edge of the supporting plate

16 Surface of the supporting plate 10 which is turned off the hand grinder 200
18 Surface of the supporting plate 10 which is turned to the hand grinder 200
20 Cut or opening
22 Center line, in particular longitudinal center line, of the cutting or opening 20
24 First longitudinal lateral edge of the cutting or opening 20
26 Second longitudinal lateral edge of the cutting or opening 20
28 Air guiding duct
30 Ege section
32 Recess of the edge section 30
34 Indentation of the edge
40 Moulding
42 Recess of te moulding 40
50 Stiffening web
60 Cushion or pad
70 Velcro closer
80 Abrasive disk
200 Grinding machine, in particular hand grinder
202 Driven shaft
204 Driving engine
206 Suction bell or exhaust bell
208 Handle
300 Abrasive dust

The invention claimed is:

1. Grinding disk (100) for being rotationally driven on a driven shaft (202) of a grinding machine (200), in particular of a hand grinder, which grinding disk has at least one supporting plate (10) with at least two cuts or openings (20) through which the abrasive dust (300) which develops when grinding can be sucked by means of at least one suction bell (206) placed in or on the grinding machine (200), wherein each cut or opening (20) is configured aerodynamically and substantially oval with two longitudinal side edges (24, 26) and a longitudinal center line (22) that extends approximately as an arc of a circle, wherein each cut or opening (20) widens towards a peripheral edge (14) of the supporting plate (10), wherein each cut or opening (20) tapers in the direction of a center of the grinding disk, whereby only one edge (26) of the longitudinal side edges (24, 26) is ground or chamfered and tapers toward a center of the grinding disk, wherein a bottom side (16) of the support plate (10) that faces away from the grinding machine (200) has a plurality of air guiding ducts (28) that lead to the cuts (20), wherein the bottom side (16) of the support plate has at least one raised edge section (30) at a periphery of the plate and between at least two cuts or openings (20) at least one molding (40) is provided on which at least one cushion or pad (60) can be mounted for removably fixing at least one abrasive disk (80).

2. Grinding disk according to claim 1, wherein the cut or opening (20) extends from the center (12) of the supporting plate (10) radially to the peripheral edge (14) of the supporting plate (10).

3. Grinding disk according to claim 1, wherein at least one radially extending stiffening web (50) is provided on or in the supporting plate (10) so as to stiffen and intercept pressure loads of the supporting plate.

4. Grinding disk according to claim 3, wherein the supporting plate has at least two cuts or openings (20), and wherein the stiffening web (50)

is provided on the surface (18) of the supporting plate which faces the grinding machine (200) and/or runs at least partially in the area between the at least two cuts or openings (20)

5. Grinding machine (200), in particular a hand grinder, comprising at least one grinding disk (100) according to claim 1.

* * * * *